United States Patent [19]

Huret et al.

[11] Patent Number: 4,650,644

[45] Date of Patent: Mar. 17, 1987

[54] ENGINE LINERS HAVING A BASE OF ALUMINUM ALLOYS AND OF SILICON GRAINS GRADED IN SIZE AND PROCESSES FOR OBTAINING THEM

[75] Inventors: Noel Huret, Noisy le Grand; Jean Meunier, Grenoble, both of France

[73] Assignee: Aluminum Pechiney, Paris, France

[21] Appl. No.: 589,064

[22] PCT Filed: Jun. 15, 1983

[86] PCT No.: PCT/FR83/00120

§ 371 Date: Feb. 13, 1984

§ 102(e) Date: Feb. 13, 1984

[87] PCT Pub. No.: WO84/00050

PCT Pub. Date: Jan. 5, 1984

[30] Foreign Application Priority Data

Jun. 17, 1982 [FR] France ..... 82 11032
Sep. 12, 1982 [FR] France ..... 82 20982

[51] Int. Cl.[4] ..... B22F 7/06; F02F 75/06

[52] U.S. Cl. ..... 419/11; 123/193 C; 419/23; 420/548

[58] Field of Search ..... 419/11; 75/229, 230, 75/231, 233, 245, 142–148; 148/11.5 P; 123/193 C; 420/548

[56] References Cited

U.S. PATENT DOCUMENTS

| | | | |
|---|---|---|---|
| 2,978,798 | 4/1961 | Wasserman et al. | 419/11 |
| 4,068,645 | 1/1978 | Jenkinson | 123/193 C |
| 4,099,314 | 7/1978 | Perrot et al. | 419/11 |

FOREIGN PATENT DOCUMENTS

| | | |
|---|---|---|
| 1160194 | 7/1957 | Fed. Rep. of Germany . |
| 2252607 | 5/1974 | Fed. Rep. of Germany . |
| 1354356 | 10/1964 | France . |
| 1448528 | 6/1966 | France . |
| 2343895 | 7/1977 | France . |
| 337661 | 5/1959 | Switzerland . |
| 530996 | 5/1946 | United Kingdom . |
| 768204 | 2/1957 | United Kingdom . |
| 805100 | 11/1958 | United Kingdom . |

OTHER PUBLICATIONS

"New Alloy Cylinder Linings Take Uncoated Pistons", *Automtive Engr.*, Sep. 1977, p. 22.

*Primary Examiner*—Stephen J. Lechert, Jr.
*Assistant Examiner*—T. J. Wallen
*Attorney, Agent, or Firm*—Oblon, Fisher, Spivak, McClelland & Maier

[57] ABSTRACT

This invention relates to internal combustion engine liners having a base of aluminum-silicon alloys and of silicon grains and processes for obtaining them.

It is characterized in that these grains are carefully graded in size and dispersed in the alloy matrix. These liners can also contain at least an intermetallic compound such as $Ni_3Sn$, for example.

These liners are obtained by extrusion or sintering of a mixture of powders.

The invention has its application particularly in the automobile industry and in any type of industry where it is desired to have liner-piston units from aluminum alloys having a good compatability.

19 Claims, 3 Drawing Figures

Figure 1:
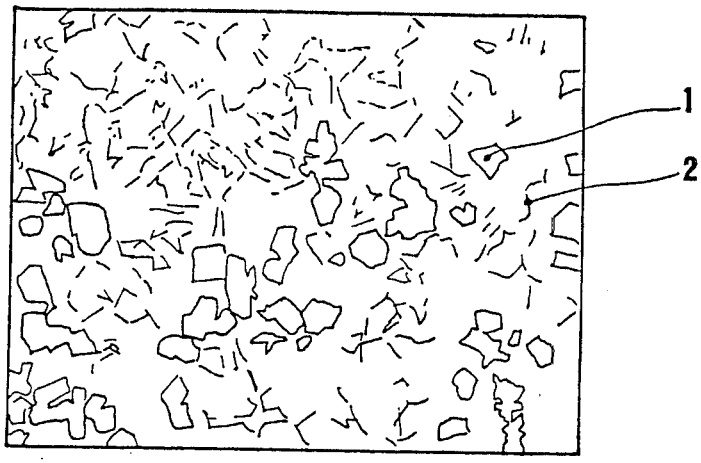

ENGINE LINERS HAVING A BASE OF ALUMINUM ALLOYS AND OF SILICON GRAINS GRADED IN SIZE AND PROCESSES FOR OBTAINING THEM

This invention relates to liners of internal combustion engines whose structure exhibits silicon grains that are graded in size and dispersed in a eutetic aluminum-silicon alloy matrix. It also relates to some of the processes for obtaining them.

Engine liners having an aluminum base are not new but their use has always caused problems of compatibility of their working surfaces with the engine elements such as the pistons that are in contact with them. Efforts have been made in various ways to reduce the difficulties encountered such as providing a steel lining, coating the surface of the cylinder bore with harder metals such as iron or chromium, without, however, being able to overcome the difficulties completely.

Then alloys were used having a better mechanical resistance such as hypereutectic aluminum-silicons but it was noticed that the primary silicon crystals that appeared during casting of the liner had, because of their relatively large size and their angular shape, a troublesome tendency to score the surface of the pistons and this led to protecting the piston surface with a covering.

Then, still desiring to benefit from certain advantages offered by the hypereutectic aluminum-silicons, an effort was made to change the structure of these alloys, particularly at the level of the silicon grains to try to give them the necessary compatibility without having to resort to further surface treatments. Of the attempts made, there can be noted

- those described in French Pat. No. 1 441 860 where an acid etching of the aluminum matrix was used to bring in relief the silicon grains then these grains were polished and,
- on the other hand, those aimed at obtaining a new casting structure. This is the case of French Pat. No. 2 235 534 in which the liner is cast under such cooling conditions so that it does not exhibit any primary silicon phase but rather fibrous or spheroidized particles with dimensions less than 10 μm.

More recently, the applicant in Pat. No. 2 343 895 also resorted to new hypereutectic A-S structures but by substituting the casting process with that of extrusion of powders obtained by atomization. Actually, this technique offers the advantage of using powders formed at a high cooling speed and in which the primary silicon grains have a relatively small size and in any case one that is smaller than that resulting from conventional casting. This size is not modified by the extrusion and thus a new structure is obtained exhibiting fine, well distributed silicon particles that notably improve the compatibility of the liner with the piston.

However, under particularly severe test conditions, a deterioration of the liner was still observed.

A thorough study of the phenomenon found that it was linked with too great a fineness of the silicon grains. Starting with these results, the present inventors realized that it was possible to improve this compatability. For this reason, the present inventors have developed liners whose structure exhibits silicon grains carefully graded in size in a relative narrow granulometry, on an average being above the maximum that led to a poor performance and below the one that was too coarse for the cast products.

This invention therefore relates to an internal combustion engine liner having a eutectic aluminum-silicon alloy base, optionally containing other elements and characterized in that its structure exhibits a distribution of silicon grains graded in size with dimensions between 20 and 50 μm.

Thus, this liner consists of a eutectic aluminum-silicon matrix, i.e., containing about 12% of silicon and in which no primary silicon grain appears. Optionally, this alloy can contain other additional elements which contribute to its mechanical characteristics or certain properties in relation to friction or wear behavior.

In this matrix are distributed silicon grains that are graded in size, i.e., responding to the narrowest possible granulometry curve whose dimensions in any case are between 20 and 50 μm. Thus, all fine silicon particles and grains that are too large which contribute to reducing the desired compatibility are excluded.

Further, to obtain a favorable compromise between the qualities provided, on the one hand, by the matrix and, on the other hand, by the silicon grains, it was possible to establish that a proportion by weight of 5 to 15% of silicon grains in relation to the mass of the liner is very suitable.

The silicon grains have a purity greater than 99.5% and preferably a calcium content less than 300 ppm. They can optionally be treated to eliminate iron from them. Their faces are different as a function of the way they are obtained. Thus, it is possible to have not only conventional grains prepared by grinding and shifting but also grains made by spraying of liquid silicon which exhibit a more rounded contour.

In regard to the aluminum-silicon alloy, preferably eutectic alloys of the $A\text{-}S_{12}U_4G_2$ type are used, i.e., containing elements such as copper and magnesium which has the effect of improving the mechanical resistance.

Further, the frictional properties of the liners are promoted by the presence of adjuvants such as graphite or any other body having an equivalent role. Preferably, a granular type artificial graphite is used, a form that physically fits in well with the other components of the liner. The most suitable proportion is between 3 and 10% by weight of the mass in which it is dispersed.

The present inventors have further found that the performances of the liner-piston units could be improved still more from the viewpoint of compatibility and particularly the appearance of certain localized sticking phenomena, which appear when the liner works above the generally accepted maximum temperatures, by adding to the liner a dispersion of at least an intermetallic compound, different from that of such compounds that are able to exist in the alloy and whose melting temperature is above 700° C.

Thus, the invention also consists in having in the liner a dispersion of at least an intermetallic compound in addition to the silicon grains graded in size.

It should be emphasized that from the structure and/or composition viewpoint this dispersion is different from the one that could be present in the base alloy. Actually, it is possible for this alloy to contain certain elements that between them can form intermetallic compounds during its processing by powder metallurgy. But these compounds belong to the very structure of the base alloy and have nothing to do with the compound or compounds involved in the invention.

The intermetallic compounds constituting this dispersion are selected from those that have a melting point above 700° C.

It has been found that the presence of these compounds in the structure of a liner having a eutectic aluminum-silicon matrix have the property of greatly reducing if not eliminating the tendency of the liner to be welded locally to the piston when certain temperature limits are exceeded.

Further, tests conducted showed that the intermetallic compounds simultaneously contribute to improving the role played by the silicon grains by creating hard spots in the liner and by thus reinforcing its resistance to wear and that of the graphite by heightening its function as a lubricating agent as shown by the measurements of the friction factor.

The intermetallic compound $Ni_3Sn$ in which three nickel atoms are combined with one tin atom to form these hexagonal type crystals has proven to be particularly high performing both in its functions as a nonsticking agent and in its functions as a lubricating and wear-resistant agent.

These compounds must be regularly distributed in the mass of the liner in the form of grains. However, to develop their effects fully, these grains are preferably graded in size, i.e., they respond to the narrowest possible granulometry curve and their dimensions are in any case between 5 and 50 μm. Thus, on the one hand, grains which are too fine are excluded because their high specific surface leads to jamming of the tools making the liners and, on the other hand, grains which are too large are excluded as they cause an increase in the friction factor.

To obtain a favorable comprise between the advantages offered by the eutectic aluminum-silicon alloy matrix, the silicon grains, the lubricant and the intermetallic compound grains, it has been found that a proportion of these latter of 5 to 15% of the mass of the liner is very suitable.

The intermetallic compound grains can exhibit faces that are different as a function of the way they are obtained. Thus, it is possible to have not only conventional grains prepared by grinding but also grains made by spraying of the compound in the liquid state which for this reason exhibit a more rounded contour.

In regard to the base alloy constituting the matrix of the material of the invention, besides the alloy of the A-$S_{12}U_4G$ type, it is also possible to use an alloy of the A-$S_{12}Z_5GU$ type.

The invention also relates to some of the processes for obtaining these liners. These processes have a common phase consisting in dividing the eutectic aluminum-silicon alloy from the liquid state into a powder. This is obtained by any existing process such as, for example, centrifugal spraying, atomization, etc. This powder is then sifted to eliminate particles of dimensions not between 60 and 400 μm, then mixed with the silicon grains with a granulometry between 20 and 50 μm and in such an amount that they represent 5 to 15% by weight of the mass of the liner; optionally, there can be added 3 to 10% by weight of graphite or any other element that can improve the quality of the liner such as silicon carbide to increase its hardness or tin to make it more suitable for friction. In case of liners intended to work beyond the generally accepted temperature limits, an intermetallic compound is incorporated in the form of grains in percentages by weight between 5 and 15% and with dimensions between 5 and 50 μm. After suitable homogenization, this mixture can then be treated in two different ways: either by sintering or extrusion.

In the case of sintering, the mixture of powders is shaped by cold pressing in a vertical or isostatic press, then sintered under controlled atmosphere. The resulting liner is then machined to suitable dimensions.

In the case of extrusion, the mixture is cold pressed in the form of billets or charged directly into the billet container of a press then extruded in the shape of tubes after optional preheating sheltered from the atmosphere.

The extruding equipment used is well known to one of ordinary skill in the art. It can be either a bridge tool or a sheet die-floating needle unit. The tube thus obtained at the press output is dressed, cut to the length of the liners and the latter are then machined.

It is possible to perform a hardening directly on the tube leaving the die then conventional annealing to improve the mechanical properties of the fabricated liner.

The mixture can also be pressed in the shape of slugs which are subjected to an indirect extrusion to form buckets whose bottom and opposite end are then cut off to obtain the liners which can then be machined. It is also possible to perform direct hardening of the buckets after extrusion.

The invention can be illustrated by the three accompanying figures which represent drawings of structures enlarged 200 times of engine liners made by various techniques.

Figure 2:
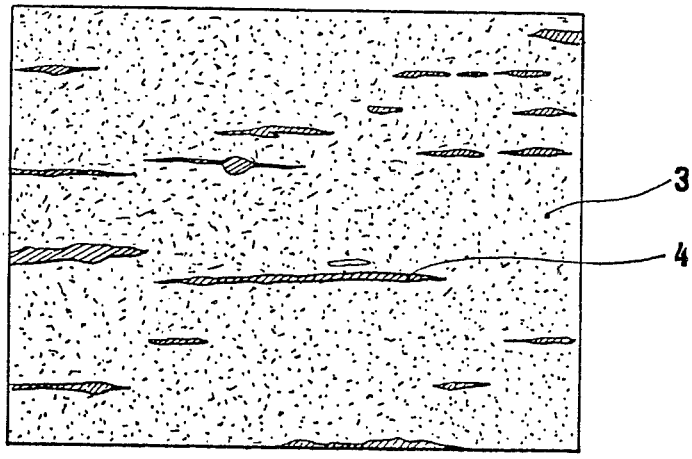
Figure 3:
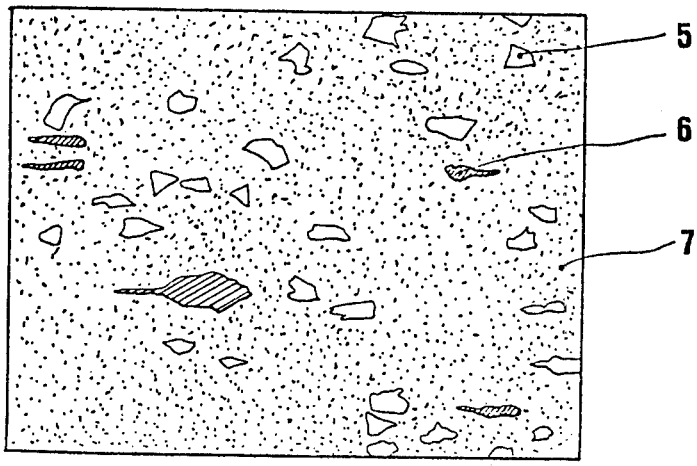

FIG. 1 corresponds to a liner obtained by casting of a hypereutectic aluminum-silicon alloy, FIG. 2 is a liner obtained by extrusion of hypereutectic aluminum-silicon alloy powder, and FiG. 3 is a liner according to the invention obtained by extrusion of a mixture of eutectic aluminum-silicon alloy powder and silicon powder graded by size.

In FIG. 1, the aluminum-silicon alloy is an A-$S_{17}U_4G$ according to the standards of the Aluminum Association which therefore contains 17% silicon and therefore is hypereutectic in silicon. Primary silicon crystals (1) can be seen to appear at the beginning of the solidification of the alloy and which are dispersed in a matrix where eutectic silicon appears in the form of needles (2). It is noted that these crystals have a relatively large size and an angular shape having the property of a troublesome tendency to score the surface of the pistons where the liners work.

In FIG. 2 the aluminum-silicon alloy is also an A-$S_{17}U_4G$ but resulting from the extrusion of a powder obtained by atomization. Because of the great cooling speed used to form this powder, the primary silicon grains (3) have a relatively small size comparable to that of eutectic silicon, and in any case, less than that resulting from conventional casting. In this figure can also be seen graphite particles (4) which are extended in the direction of the extrusion and represent about 3% by weight of the mass of the liner.

The excessively small size of the silicon grains, of the liners thus made, is the cause of their deterioration during tests under particularly severe conditions.

In FIG. 3, the aluminum-silicon alloy is an A-$S_{12}U_4G$ which contains 12% silicon and therefore is eutectic in silicon. It also results from extrusion of metal obtained by atomization, but, according to the invention, there is added before extrusion about 5% by weight of silicon powder whose grains (5) have faces of particles resulting from a grinding and which have a dimension between 20 and 50 μm. These grains are dispersed in a eutectic matrix in which can be seen silicon particles (7) which have coalesced and graphite particles (6) associated at a rate of 3% by weight. The entirely original texture of the liners according to the invention will be noted. It is a texture that contributes considerably to improving the compatibility of the liners, thus made, with the pistons.

The liners, the object of the invention, have application particularly in the automobile industry and in any type of industry where it is desired to have liner-piston units from aluminum alloys having good compatability.

We claim:

1. An internal combustion engine liner comprising an eutectic aluminum-silicon alloy matrix made from particles of dimensions between 60–400 μm, wherein the structure of said alloy has a distribution of silicon grains having dimensions exclusively within the range of 20–50 μm.

2. The liner as in claim 1, wherein the silicon grains represent 5 to 15% of the mass of the liner.

3. The liner as in claim 1, wherein the silicon grains have the faces of particles resulting from a grinding.

4. The liner as in claim 1, wherein the silicon grains have the faces resulting from spraying of liquid silicon.

5. The liner as in claim 1, wherein the eutectic aluminum-silicon alloy is A-$S_{12}U_4G$.

6. The liner as in claim 1, which further comprises graphite.

7. The liner as in claim 6, wherein the graphite content of the liner is between 3 and 10% by weight.

8. The liner as in claim 6, wherein said graphite is a granular artificial graphite.

9. The liner as in claim 1, wherein said liner contains a dispersion of at least one intermetallic compound different from that of such compounds able to exist in the alloy and whose melting temperature is above 700° C.

10. The liner as in claim 9, wherein the intermetallic compound is $Ni_3Sn$.

11. The liner as in claim 9, wherein the intermetallic compound is in the form of grains graded in size with dimensions between 5 and 50 μm.

12. The liner as in claim 9, wherein the intermetallic compound represents 5 to 15% by weight of the mass of the liner.

13. The liner as in claim 9, wherein the grains of the intermetallic compound have the faces of particles resulting from a grinding.

14. The liner as in claim 9, wherein the grains of the intermetallic compound have the faces of particles resulting from solidification of a sprayed liquid.

15. The liner as in claim 9, wherein the eutectic aluminum-silicon alloy belongs to the group consisting of A-$S_{12}U_4G$ and A-$S_{12}Z_5GU$.

16. The liner as in claim 1, wherein said eutectic aluminum-silicon alloy contains about 12% of silicon.

17. The liner as in claim 1, wherein the silicon grains of said eutectic aluminum-silicon alloy have a purity of greater than 99.5%.

18. The liner as in claim 17, wherein said silicon grains have a calcium content of less than 300 ppm.

19. An internal combustion engine liner comprising an eutectic aluminum-silicon alloy matrix, wherein the structure of said alloy has a distribution of silicon grains having dimensions exclusively within the range of 20–50 μm which is produced by:

(a) dividing the eutectic aluminum-silicon alloy from the liquid state into a powder having dimensions between 60 and 400 μm, then (b) mixing said alloy with silicon grains having a granulometry exclusively between 20 and 50 μm in such an amount that they represent 5 to 15% by weight of the mass of the liner.

* * * * *